United States Patent [19]

Urban et al.

[11] Patent Number: 4,473,192

[45] Date of Patent: Sep. 25, 1984

[54] TABLET BREAKING DEVICE

[75] Inventors: Joseph J. Urban, Richboro, Pa.; Norman L. Henderson, Gladstone, N.J.

[73] Assignee: Hoefchst-Roussel Pharmaceuticals Incorporated, Somerville, N.J.

[21] Appl. No.: 341,730

[22] Filed: Jan. 22, 1982

[51] Int. Cl.[3] ..... B26B 11/00; B26B 3/02

[52] U.S. Cl. ..... 241/168; 225/93; 225/103; 241/DIG. 27

[58] Field of Search ..... 241/168, 169.21, DIG. 27; 225/93, 105; 30/114, 124

[56] References Cited

U.S. PATENT DOCUMENTS

| | | | |
|---|---|---|---|
| 3,650,445 | 3/1972 | Heltzman | 225/93 |
| 3,815,802 | 6/1974 | Stevens | 225/93 |
| 4,159,568 | 7/1979 | Berner | 30/124 |
| 4,173,826 | 11/1979 | Leopoldi et al. | 30/124 |
| 4,179,806 | 12/1979 | Lieptz | 30/124 |
| 4,199,863 | 4/1980 | Deckert | 30/124 |
| 4,226,376 | 10/1980 | Pfleger | 241/99 |

FOREIGN PATENT DOCUMENTS 2086715 12/1971 France .

OTHER PUBLICATIONS

Endicott et al., "New Instrument and Method for Evaluating Tablet Fracture Resist", J. Pharm. Sci., 50, 4 (1961), pp. 343–346.

Brook et al., "Crushing-strength of Compressed Tablets I", J. Pharm. Sci., 57, 3 (1968), pp. 481–484.

*Primary Examiner*—Mark Rosenbaum

*Assistant Examiner*—Timothy V. Eley

[57] ABSTRACT

A tablet breaking device comprises a base and a tablet splitting edge in the base. Means are provided for holding a tablet such that a portion of the tablet extends over the tablet splitting edge. The tablet holding means comprises an elongated opening tapering in depth and width. A moment of force sufficient to break the tablet can be created about the tablet splitting edge by applying a force substantially normal to a portion of the tablet extending over the tablet splitting edge.

12 Claims, 6 Drawing Figures

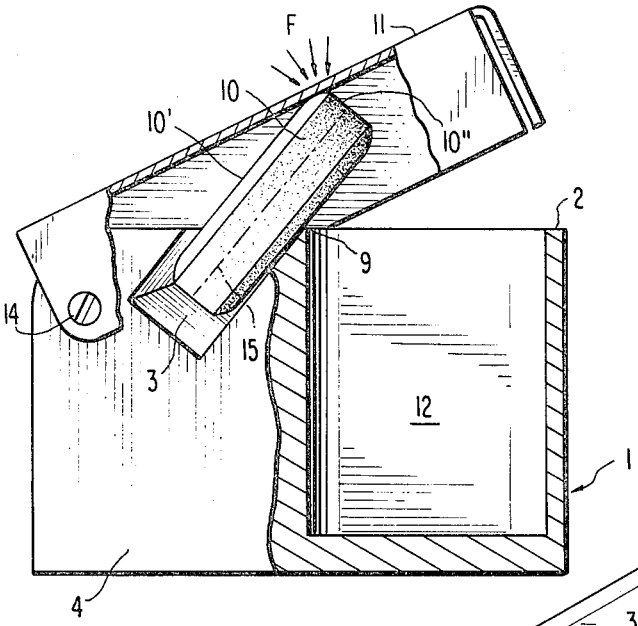
FIG. 1
FIG. 2
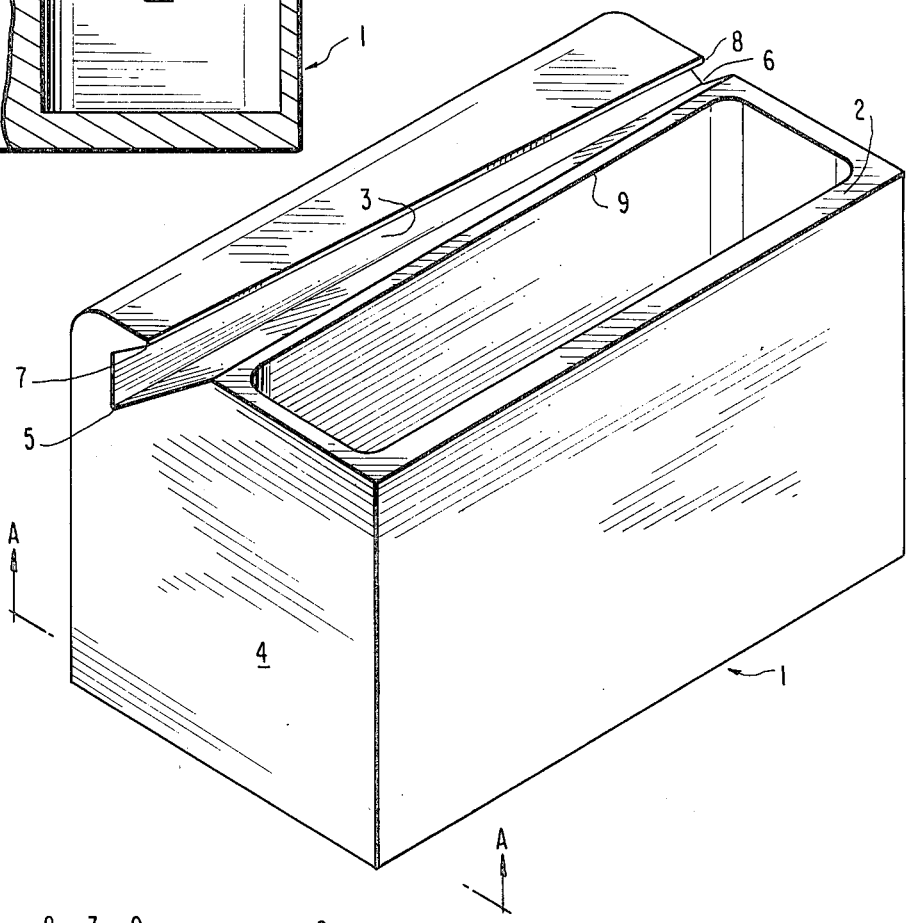
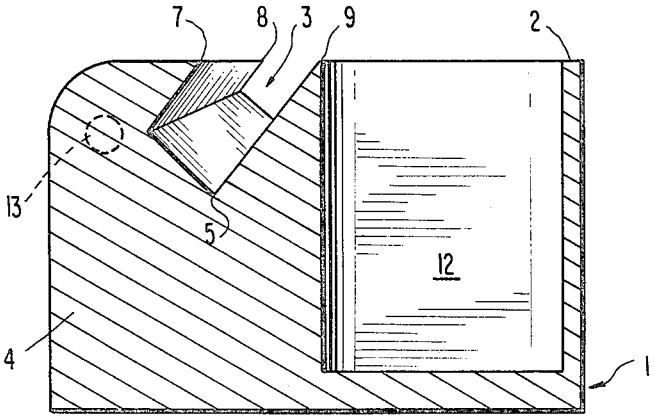
FIG. 3

FIG. 5
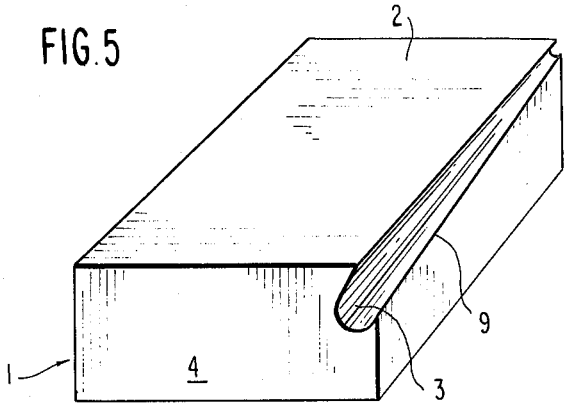
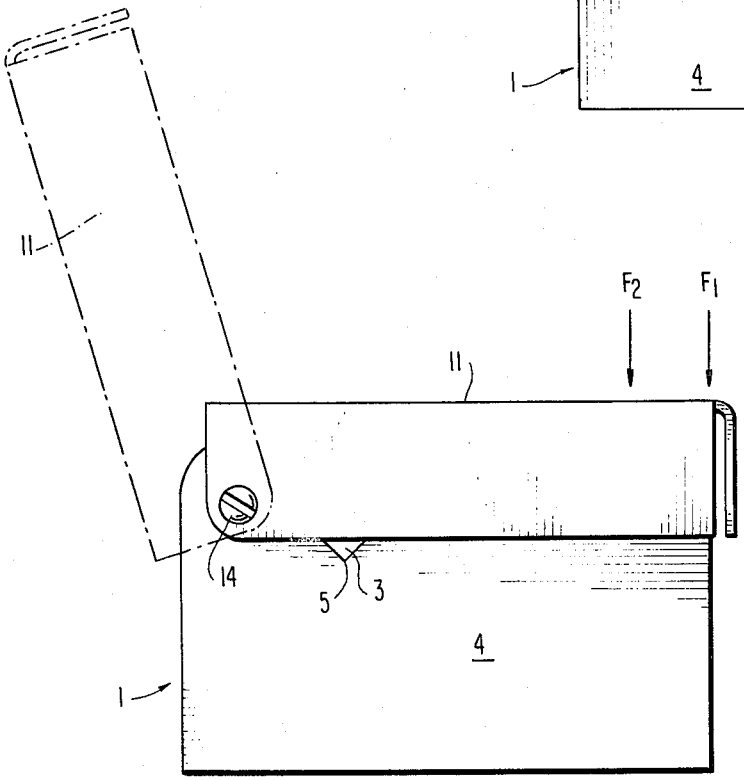
FIG. 4
FIG. 6
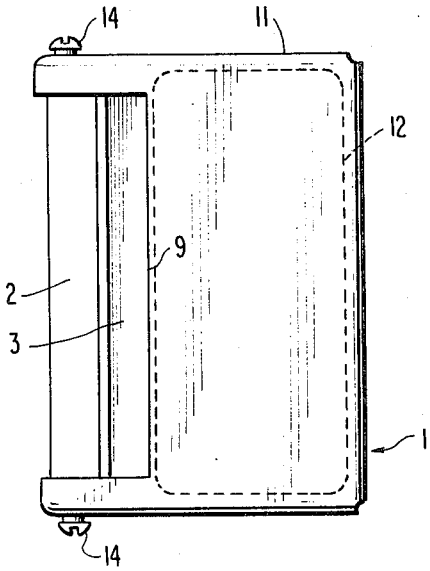

TABLET BREAKING DEVICE

BACKGROUND OF THE INVENTION

This invention relates to a device for breaking tablets, such as tablets containing unit dosages of pharmaceuticals.

Tablets have long been convenient dosage forms for a variety of materials, such as medicaments, vitamins, foods and detergents. Tablets are frequently orally administered to animals and humans. While tablets for animal and human consumption are normally available in unit dosages, it is frequently necessary to reduce the dose, such as by breaking the tablet in half, and consuming only half the tablet. The remainder of the tablet is saved for later use.

Traditionally, tablets have been broken by hand. This can be accomplished by breaking the tablet between the second and third fingers of one hand while the thumb is used as a fulcrum or by using the index fingers of both hands, while the thumbs serve as a fulcrum. These manual methods are not always suitable. For example, persons with decreased strength in the hands or those suffering from diseases, such as arthritis, or those with handicaps, such as amputees, may encounter considerable difficulty in breaking tablets.

Even in those instances in which it is possible for a person to manually break a tablet, it is not always possible to achieve the separation in a uniform or reproducible manner. For example, unless the tablet is scored, it may be difficult to locate the mid-point of the tablet where the fulcrum is to be located, and even when a tablet is scored, it is not always desired to have tablet portions corresponding to the sizes provided by the score line. In the case of pharmaceuticals, it is important that tablets be broken in predictable proportions to ensure administration of the correct dosage to the patient.

There exists a need in the art for a tablet breaking device that can be used by persons having physical disabilities, such as reduced hand strength. There also exists a need in the art for a tablet breaking device that can achieve separation of tablets in a uniform, reproducible and controllable manner. The device should be of simple construction, easy to manufacture and simple to operate to ensure widespread availability to those most in need.

SUMMARY OF THE INVENTION

Accordingly, this invention aids in fulfilling these needs in the art. Specifically, this invention provides a tablet breaking device comprising a base and a tablet splitting edge in the base. Means for holding a tablet such that a portion of the tablet extends over the tablet splitting edge is provided. A moment of force can be created about the tablet splitting edge to break the tablet. The moment of force is created by applying a force substantially normal to a portion of the tablet extending over the tablet splitting edge. The tablet holding means comprises an elongated opening tapering in depth and width.

This invention also provides a tablet breaking device having a tablet breaking means rotatable over the top surface. The tablet breaking device comprises a base having a top surface and means for holding the tablet at an angle of about 5° to about 70° relative to the top surface. A portion of the tablet extends in an inclined, cantilevered position beyond the top surface. A tablet splitting edge in the base member is located under the tablet. The tablet breaking means is rotated over the top surface and exerts a force substantially normal to the portion of the tablet extending beyond the top surface. A moment of force sufficient to break the tablet is thereby created about the tablet splitting edge. A cavity is provided in the base member for receiving the broken portion of the tablet. After the tablet is broken, the tablet breaking means covers the cavity, but not the tablet holding means. This makes it possible to easily remove the portion of the tablet remaining in the tablet holding means by turning the tablet breaking device upside down. Since the tablet breaking means covers the cavity, the other portion of the broken tablet is retained in the cavity for storage and future use.

BRIEF DESCRIPTION OF THE DRAWINGS

This invention will be more fully understood by reference to the following drawings, in which like numerals identify like parts:

FIG. 1 is a cut-away side view of a device of this invention depicting operation of the device in breaking a tablet;

FIG. 2 is a perspective view of a tablet breaking device according to the invention;

FIG. 3 is a view taken through section A—A of FIG. 2;

FIG. 4 is a side view of the device of FIG. 2 fitted with a tablet breaking lid means;

FIG. 5 is another embodiment of the device of the invention in which the elongated tablet holding means is tapered in dimension along the splitting edge; and FIG. 6 illustrates a tablet splitting device in which a tablet breaking lid means covers the broken tablet receiving cavity, but not the tablet holding means, after the tablet is broken.

DETAILED DESCRIPTION

First of all, the operation of the device of this invention will be described. Referring to FIG. 1, which is a cutaway side view of a tablet breaking device 1 according to this invention, it will be seen that the device comprises a base 4 having a top surface 2 and means 3 for holding a tablet 10 such that a portion of the tablet 10 extends beyond the top surface 2. More particularly, the tablet 10 is held in an inclined, cantilevered position with at least a portion of the cantilevered segment of the tablet extending beyond the top surface. A tablet splitting edge 9 contiguous with the tablet holding means 3 is provided in the base 4. Tablet breaking means in the form of a lid 11 is rotatable over the top surface 2 of the device 1. When the lid 11 contacts tablet 10, a force F having a component substantially normal to the axis 15 and the surface 10' of the tablet is exerted proximate the outer edge 10'' of the portion of the tablet 10 extending beyond the top surface 2. A moment of force is thereby created about the splitting edge 9, and this moment of force is sufficient to break the tablet 10 into two pieces, one piece being that in the tablet holding means 3 and the other piece being that extending over the tablet splitting edge 9. As depicted in FIG. 1, the tablet splitting edge 9 is below the tablet 10, and the base member 4 includes a cavity 12 for receiving a broken portion of the tablet 10.

The construction of the tablet splitting device 1 of FIG. 1 is shown in greater detail in FIGS. 2 and 3. Referring to FIG. 2 the tablet breaking device 1 has a top surface 2 and means 3 for holding a tablet. The tablet holding means 3 comprises an elongated opening or slot in the top surface 2 of the device 1. The opening 3 extends from end to end of base 4. The opening 3 tapers in depth such that the depth of the opening diminishes from edge 5 of the opening to edge 6. The width of the opening 3 also tapers in dimension such that the width narrows from edge 7 of the opening to edge 8. Thus, in the embodiment depicted in FIG. 2, the elongated opening 3 tapers in dimension such that the depth of the opening diminishes as the width of the opening diminishes. It will be appreciated that the tapering dimensions of the elongated opening 3 make it possible to accommodate tablets of different dimensions. For instance, the tablet breaking device 1 can be made to accommodate large tablets near the edges 5 and 7 of opening 3 and smaller tablets nearer edges 6 and 8.

The tablet breaking device 1 also includes a tablet splitting edge 9. As depicted in the Figures, splitting edge 9 is part of the top surface 2 of the tablet breaking device 1. It is to be understood that the tablet splitting edge could also be a knife or blade installed in base 4 of the tablet splitting device 1, but this embodiment is less preferred because additional assembly is required. Also, the tablet splitting edge could be located below the top surface 2 provided that the tablet was adequately supported. Also, in this event it is preferred that a portion of the tablet extend beyond the top surface.

FIG. 3, which is a view taken through section A—A of FIG. 2, shows the elongated opening 3 tapering in depth such that the depth diminishes into the plane of the Figure. It will be apparent from this view that the tablet breaking device 1 can not only accommodate tablets of different size, but will also accommodate tablets of the same size, and that it is possible to vary the portion of the tablet extending beyond the top surface 2 by changing the position of the tablet in the opening 3. This enables one to break tablets of the same size along different break lines to give different size portions, such as one eighth or one quarter or one half of the tablet.

In the device depicted in FIGS. 2 and 3, it is to be understood that the cavity 12 for receiving the broken portion of the tablet is an optional embodiment. While use of cavity 12 is preferred, the device of this invention can be employed without the cavity. Also, the device depicted in FIGS. 2 and 3 does not include the tablet breaking lid 11 depicted in FIG. 1; nevertheless, the device depicted in FIGS. 2 and 3 operates on the same principle. A force is applied to a portion of the tablet extending over the splitting edge 9 and substantially perpendicular to the axis 15 of the tablet in order to create a moment of force about the slipping edge 9 sufficient to break the tablet. As depicted in FIG. 1, surface 10' is parallel to the axis 15 of the tablet 10. The breaking force can be applied by finger or hand pressure or by other means. When a rotatable lid, such as lid 11, is employed, a hole 13 (shown in phantom in FIG. 3) can be drilled and tapped in the base 4 to accommodate attachment means, such as machine screws 14 shown in FIGS. 1, 4 and 6.

A side view of the device of FIG. 2 fitted with a tablet breaking means 11 is shown in FIG. 4. As depicted in FIG. 4, the lid 11 is secured at one end of base 4 and is rotatable about the axis of attachment means, such as machine screws 14. The tablet breaking means could also be hinged at one end of the base and rotatable over the top surface of the device. When the lid 11 is in a raised position (as shown in phantom in FIG. 4), a tablet can be inserted in the tablet holding means in the base 4 of the device 1. The lid 11 can then be lowered. It will eventually contact the tablet in the tablet holding means (see FIG. 1). Continued application of force on the lid will result in a statically determinant system, and if sufficient force is applied, the tablet will break. The lid 11 will then rest on the top surface (2 in FIG. 2) of the device. The rotatable lid means 11 has several advantages. First of all, since it is secured to the base 4, it forms an integral part of the device and will not become lost or misplaced. Also, use of lid means 11 makes it possible to increase the moment of force about the splitting edge 9. For example, force $F_1$ depicted in FIG. 4 will produce a greater moment of force about splitting edge 9 than will a force $F_2$ of equal magnitude, because the moment arm is greater in the case of force $F_1$. Similarly, a force such as $F_1$ or $F_2$ applied to the lid means 11 will produce a greater moment of force about the splitting edge 9 than will a force applied directly to the tablet, such as by thumb pressure, assuming the forces are of equal magnitude. Again, the difference is in the length of the moment arm. While lid 11 is shown as terminating slightly beyond base 4, it is to be understood that the lid could be further extended beyond the base to provide even greater moments of force about the splitting edge 9. The additional leverage provided by this embodiment of the invention will be particularly beneficial to physically disabled patients, who are unable to apply sufficient breaking force to the tablet in any other way.

In FIG. 5 there is depicted another tablet splitting device according to this invention. The device 1 has a top surface 2 and an elongated opening 3 for holding a tablet in base member 4. As shown in FIG. 5, the elongated opening 3 is in the form of a slot tapering in dimension along the splitting edge 9. The device depicted in this Figure is also capable of handling tablets of different size or handling tablets of the same size to provide broken portions of varying dimensions. Because the opening 3 tapers in dimension along the splitting edge 9, it is possible to break tablets along diagonal breaklines.

Another tablet breaking device according to this invention is depicted in FIG. 6. Here again, the tablet breaking device 1 has a top surface 2 and a tablet holding means 3. Again, the tablet holding means 3 is in the form of an elongated slot in the top surface 2. As depicted in FIG. 6, the elongated opening 3 does not taper in dimension. Rather, the opening is of substantially constant cross-sectional area throughout its length. In all other respects, the elongated opening 3 depicted in FIG. 6 is of the same configuration as the elongated opening 3 depicted in FIGS. 2 and 3. In FIG. 6, the tablet breaking device is fitted with lid 11 rotatable about the axis of each attachment member, such as machine screws 14. The device 1 includes a cavity 12 (shown in phantom) for receiving the broken portion of the tablet. The lid 11 serves the same function as lid 11 in FIGS. 1 and 4. The difference is that, after the tablet is broken, the lid 11 in FIG. 6 covers the cavity 12 but not the tablet holding means 3. This embodiment of the invention is also advantageous for those suffering physical disabilities and in particular persons having poor manual dexterity. Specifically, once the tablet is broken, a portion of the tablet will fall into cavity 12 and a portion of the tablet will remain in tablet holding means 3. By turning the device 1 upside down while holding the lid 11 closed, the portion of the tablet in the tablet holding means 3 can be allowed to fall into the hand for immediate use. The remaining portion of the tablet in cavity 12 can be stored in the cavity for future use. Because the cavity is closed, the remaining portion of the tablet is protected from contaminants.

The tablet holding means depicted in the Figures comprises an elongated slot or opening 3 capable of holding one tablet or a multiplicity of tablets in side-by-side arrangement. When more than one tablet is inserted in the slot 3 of FIG. 4, cantilevered tablet segments of different lengths are provided, and the tablet breaking means 11 is capable of simultaneously exerting tablet breaking forces on the tablets. It will be understood, however, that an elongated slot is not required in the device of FIG. 6; the base 4 could be provided with a single opening capable of accommodating only tablets of a selected size. Further, the bottom of the cavity can be of any shape. While the bottom of elongated opening 3 in FIGS. 2 and 3 is V-shaped, in FIG. 5 it is curvilinear. The shape will frequently be dictated by the ease of fabrication.

Generally, the tablet will be held in the tablet holding means in an inclined, cantilevered position with at least a portion of the cantilevered segment of the tablet extending beyond the top surface. Typically, axis 15 corresponding to a diameter of the tablet will form an angle of about 5° to about 70° with the top surface 2 of the device. Preferably, this angle will be about 15° to about 40°. It is not necessary that the entire portion of the tablet to be broken extend beyond the top surface. When a tablet breaking means, such as lid 11 is employed, it is sufficient if only a portion of the tablet extends beyond the top surface; this extended portion should be sufficient to permit application of the breaking force to the edge of the tablet by the tablet breaking means.

The force F in FIG. 1 applied to axis 15 and proximate the outer edge 10'' of tablet 10 is the only force that needs to be applied to cleanly break the tablet. For this reason, the force F can be termed the "breaking force". It is not necessary to apply forces along the remaining portions of the surface 10'; such forces would tend to form compressive stresses and cause the tablet to crumble. The breaking force is alone sufficient to cause the tablet to snap.

The tablet breaking device of this invention can be fabricated from a wide variety of materials. For example, the device can be cast or machined from metal, plastic, rubber or glass. The tablet breaking means, such as lid 11, can be fabricated from the same or similar material. It is also possible to fabricate the device by casting or injection-molding suitable resins, glass, metal, rubber or plastics. For instance, the device shown in FIG. 4 could be made of a plastic material with the lid 11 being an integral part of the device with the plastic acting as a hinge connecting the lid 11 to the base 4. It is also possible to fabricate the device of this invention from wood or ceramics, although these materials are less preferred.

The tablet breaking device of this invention makes it possible to break tablets with a minimum of force. This makes the invention particularly well suited for use by persons, such as geriatric patients, suffering from physical disabilities. The device of this invention also makes it possible to break tablets to provide tablet portions of uniform, controllable, predictable and reproducible size. This makes the invention particularly well suited for use by all persons, even those without physical disabilities.

What is claimed is:

1. A tablet breaking device comprising a base member having a top surface and means for holding a tablet at an angle of about 5° to about 70° relative to the top surface and for restricting downward movement of the tablet, wherein a portion of the tablet extends in an inclined cantilevered position beyond the top surface;

a tablet splitting edge in the base member under the tablet about which a moment of force sufficient to break the tablet can be created by applying a force substantially normal to a portion of the tablet extending beyond the top surface;

a cavity in the base member for receiving a broken portion of the tablet; and tablet breaking means rotatable over the top surface for exerting the force substantially normal to the tablet;

wherein the tablet breaking means covers the cavity, but not the tablet holding means, after the tablet is broken;

wherein the tablet holding means comprises an elongated linear opening having a tapering depth, which increases from a minimum depth at one end of the opening to a maximum depth at the other end of the opening, and a length sufficient for the tablet to be moved along the length thereof while said downward movement of the tablet is restricted to permit breaking the tablet into different proportions in a single breaking step.

2. Tablet breaking device according to claim 1 wherein the opening tapers in depth and width and the taper is such that the depth of the elongated opening diminishes as the width of said opening diminishes.

3. Tablet breaking device according to claim 1 comprising tablet breaking means rotatable over the top surface for contacting the tablet proximate the outer edge of the portion of the tablet extending beyond the top surface, wherein said rotatable breaking means has a surface beyond the outer edge of the tablet, wherein the breaking force is applied to said surface of the breaking means.

4. Tablet breaking device according to claim 1 having tablet holding means for a multiplicity of tablets in side-by-side arrangement and providing cantilevered tablet segments of different lengths; wherein the tablet breaking means is capable of simultaneously exerting tablet breaking forces on all the tablets.

5. Tablet breaking device according to claim 1 including tablet breaking means hinged at one side of the top surface for exerting a force substantially normal to the portion of the tablet extending beyond the top surface to thereby create a moment of force about the splitting edge sufficient to break the tablet.

6. A tablet breaking device comprising a base member having a top surface and means for holding a tablet at an angle of about 5° to about 70° relative to the top surface and for restricting downward movement of the tablet such that a portion of the tablet extends in an inclined cantilevered position beyond the top surface;

a tablet splitting edge in the base member under the tablet about which a moment of force sufficient to break the tablet can be created by applying a force substantially normal to the portion of the tablet extending beyond the top surface;

a cavity in the base member for receiving a broken portion of the tablet; and tablet breaking means rotatable over the top surface for exerting the force substantially normal to the tablet;

wherein the tablet holding means comprises an elongated linear opening having a tapering depth, which increases from a minimum depth at one end of the opening to a maximum depth at the other end of the opening, and a length sufficient for the tablet to be moved along the length thereof while said downward movement of the tablet is restricted to permit breaking the tablet into different proportions in a single breaking step;

and wherein the tablet holding means substantially prevents rotation of the tablet about the tablet splitting edge when the force is applied and the tablet breaking means covers the cavity, but not the tablet holding means, after the tablet is broken.

7. Tablet breaking device according to claim 6 wherein the taper is such that the depth of the elongated opening diminishes as the width of said opening diminishes.

8. Tablet breaking device according to claim 6 having tablet holding means for a multiplicity of tablets in side-by-side arrangement and providing cantilevered segments of different lengths; wherein the tablet breaking means is capable of simultaneously exerting tablet breaking forces on all the tablets.

9. Tablet breaking device according to claim 6 including tablet breaking means hinged at one side of the top surface for exerting a force substantially normal to the portion of the tablet extending beyond the top surface to thereby create a moment of force about the splitting edge sufficient to break the tablet.

10. Tablet breaking device according to claim 6 having tablet holding means for a multiplicity of tablets in side-by-side arrangement and providing cantilevered tablet segments of different lengths; wherein the tablet breaking means is capable of simultaneously exerting tablet breaking forces on all the tablets.

11. Tablet breaking device according to claim 6 wherein the channel tapers in dimension along the splitting edge to break a tablet along a diagonal breakline.

12. Tablet breaking device according to claim 6 comprising a tablet breaking means rotatable over the top surface for contacting the tablet proximate the outer edge of the portion of the tablet extending beyond the top surface, wherein said rotatable breaking means has a surface beyond the outer edge of the tablet and wherein the breaking force is applied to said surface of the breaking means.

* * * * *